US009157700B1

(12) United States Patent
Hansen

(10) Patent No.: US 9,157,700 B1
(45) Date of Patent: Oct. 13, 2015

(54) FIREARM SLING

(71) Applicant: Joe Hansen, Tujunga, CA (US)

(72) Inventor: Joe Hansen, Tujunga, CA (US)

( * ) Notice: Subject to any disclaimer, the term of this patent is extended or adjusted under 35 U.S.C. 154(b) by 0 days.

(21) Appl. No.: 14/592,448

(22) Filed: Jan. 8, 2015

(51) Int. Cl.
*F41C 33/00* (2006.01)
*F41C 23/02* (2006.01)

(52) U.S. Cl.
CPC ..... *F41C 33/002* (2013.01); *F41C 23/02* (2013.01)

(58) Field of Classification Search
CPC ..... F41C 33/002; F41C 33/001; F41C 23/02
USPC ..... 224/150, 913, 258, 257, 578, 149
See application file for complete search history.

(56) References Cited

U.S. PATENT DOCUMENTS

| | | | | |
|---|---|---|---|---|
| 1,292,875 | A * | 1/1919 | Randall | 224/150 |
| 4,249,686 | A * | 2/1981 | Morwood | 224/150 |
| 4,511,070 | A * | 4/1985 | Hightower | 224/150 |
| 5,810,219 | A * | 9/1998 | Rosenfield | 224/150 |
| 6,068,167 | A * | 5/2000 | Hopson | 224/150 |
| 6,325,258 | B1 * | 12/2001 | Verdugo et al. | 224/150 |
| 7,069,624 | B2 * | 7/2006 | Johnson | 24/302 |
| 2004/0159687 | A1 * | 8/2004 | Eliason | 224/150 |
| 2004/0188476 | A1 * | 9/2004 | Johnson | 224/150 |
| 2008/0217371 | A1 * | 9/2008 | Wemmer | 224/579 |

* cited by examiner

*Primary Examiner* — Brian D Nash
*Assistant Examiner* — Corey Skurdal
(74) *Attorney, Agent, or Firm* — Fulwider Patton LLP

(57) ABSTRACT

A three point weapon sling is disclosed having a side release non-reversible buckle that holds a temperature resistant strap and can be mounted to a variety of different makes and sizes of weapons. The sling incorporates a three-point design that permits multiple carry and shooting positions, and is adjustable to varying lengths without excess strap to become tangled or otherwise interfere with the use of the weapon.

6 Claims, 7 Drawing Sheets

FIREARM SLING

BACKGROUND

Rifles and similar firearms are typically worn using a strap that connects to the fore and aft portion of the weapon, creating a sling. These slings vary in shape and connection types, and are adjustable to account for different size user and different preferences of the user. Used by hunters and in combat, the slings keep the weapon in a ready position to allow a quick transition from carry to firing. In combat, this transition can be critical to the user.

The present inventor has identified several issues with the sling that the present invention is intended to address. First, many slings are designed for either a particular firearm or manufacturer, so a user may require several slings to use with different weapons. Particularly with older rifles and the like, current slings do not mount effectively as compared with newer guns. Also, an issue arises when the sling must be assembled in darkness or in cramped quarters, such as a fox hole or duck blind. Typical buckles allow insertion of the mating components in either orientation, which can lead to a twisting of the sling and difficulty re-orienting the weapon for firing quickly. Also, it would be advantageous to have a sling that allows for rapid three-way configuration that is adaptable to the specific preferences of the user.

These, and other improvements, are accomplished by the present invention.

SUMMARY OF THE INVENTION

The present invention is a three point weapon sling with side release buckles that hold a temperature resistant strap and can be mounted to a variety of different makes and sizes of weapons. The sling incorporates a three-point design that permits multiple carry and shooting positions, and is adjustable to varying lengths without excess strap to become tangled or otherwise interfere with the use of the weapon.

A quick adjustment capability to enable the shooter to quickly change the sling length and yet have no excess material to flap or tangle. The sling provides the most comfort and most versatility of any available weapon sling on the market, and adjusts to multiple positions and multiple sizes to accommodate the user's preference.

DETAILED DESCRIPTION OF THE PREFERRED EMBODIMENTS

Figure 1:
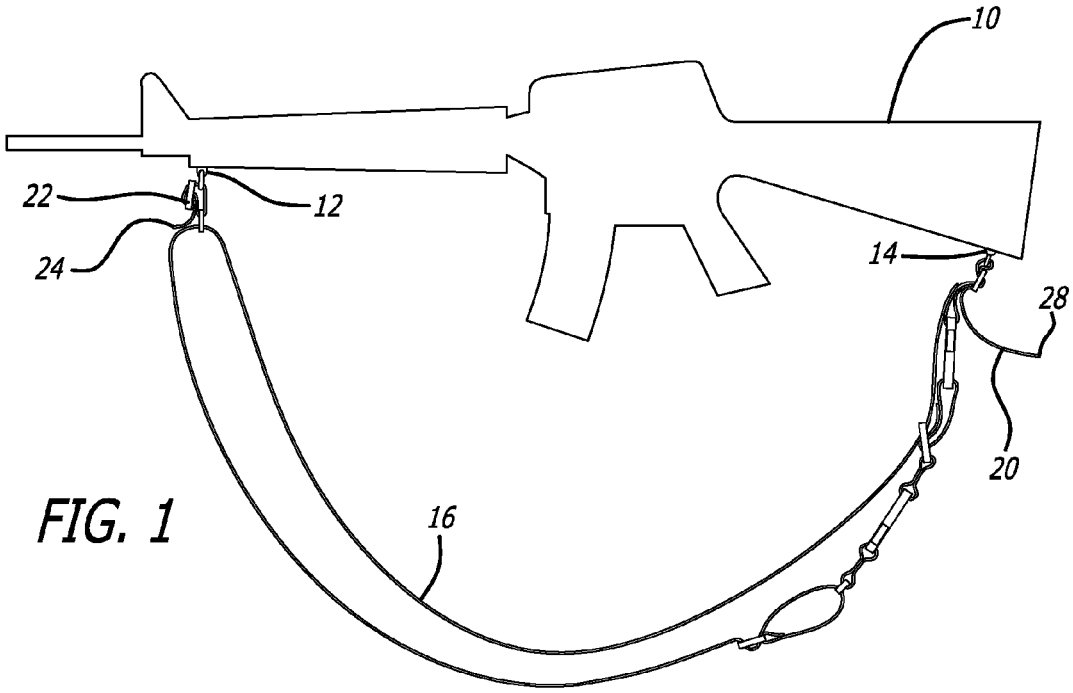
FIG. 1 is a side view of the sling of the present invention connected to a weapon.
Figure 2:
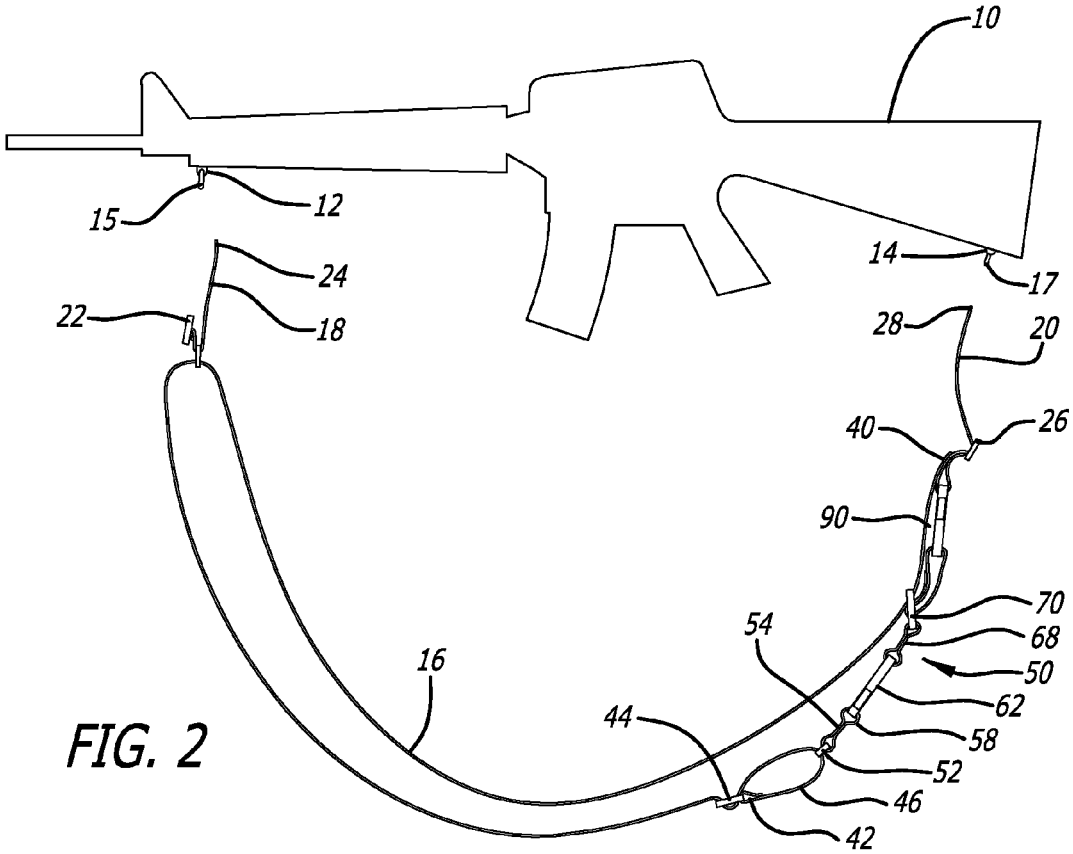
FIG. 2 is the sling of FIG. 1 released from the weapon.

FIG. 1 illustrates a weapon 10, such as a shoot gun, rifle, or other long barrel firearm having multiple contact points 12, 14. The contact points 12,14 can be swiveling loops 15,17 that are pinned into the weapon 10 and allow for some play in the loops, at least in the forward and rearward direction. Other types of contact points having a slot for a strap can be used with the present invention, and it is not limited to any particular weapon or contact point.

A multi-point sling 16 is shown attached to the weapon 10 at the contact points 12,14. In the depicted embodiment, a first connecting strap 18 having a width of one inch couples the sling 16 to the contact point 12 through loop 15, and a second connecting strap 20 having a width of one inch couples the sling 16 to the contact point 14 through loop 17. An adjustable slip lock buckle 22 receives the end 24 of the connecting strap 18 after passing through the contact point 12 at loop 15 to secure the sling 16 to the front of the weapon 10. Similarly, a second adjustable slip lock buckle 26 receives the end 28 of the connecting strap 20 after passing through the contact point 14 at loop 17 to secure the sling 16 to the rear of the weapon 10. The adjustable buckles 22, 26 preferably have jagged teeth at the entry recesses to prevent slippage of the connecting straps 18,20 once they are secured in the buckles. Once the connecting straps 18, 20 are locked into the buckles 22, 26, respectively, the sling keeper loops formed by the closed configuration of strap 18/buckle 22 and strap 20/buckle 26 are established. The sling is preferably attached to the weapon at these keeper loops in a reliable and easy-to-use manner, and the sling can be quickly released by releasing the straps 18,20 from their respective slip lock buckles in a known manner.

Figure 3:
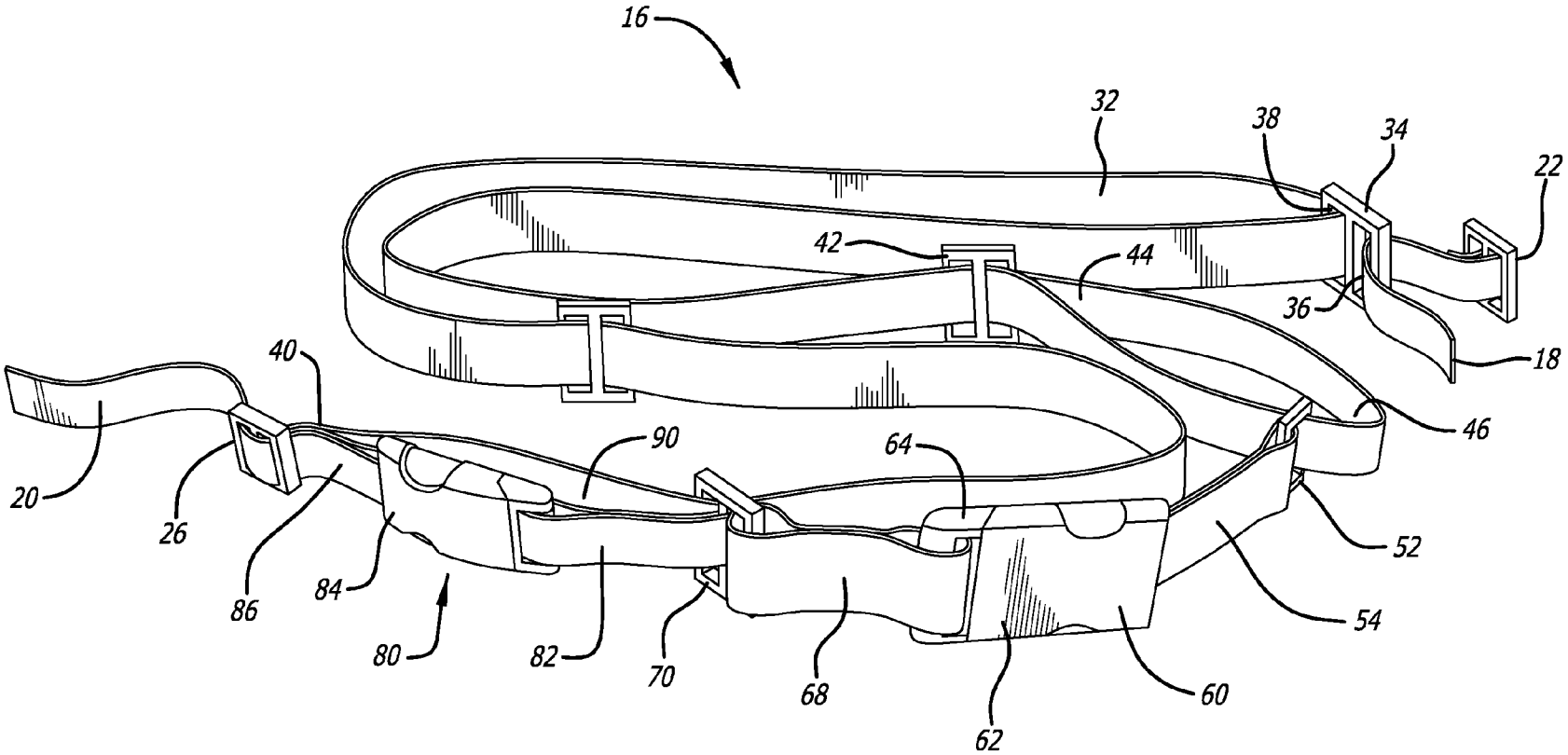
FIG. 3 is an enlarged elevated perspective view of the sling without the weapon.
Figure 4:
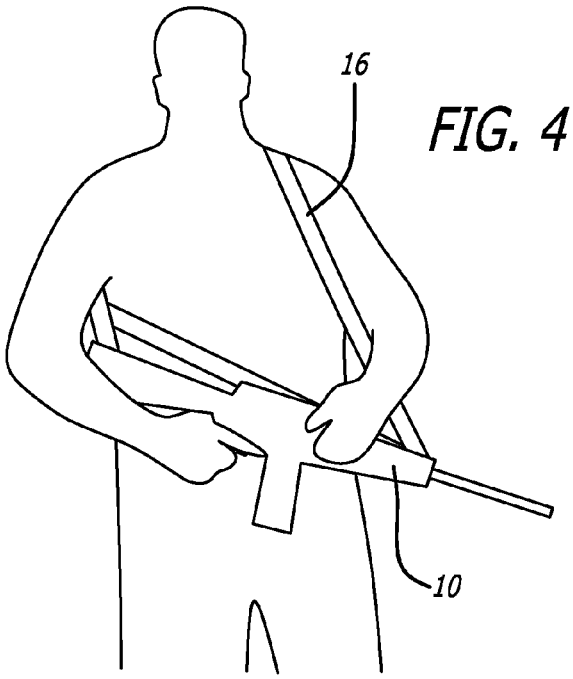
FIGS. 4-9 are illustrations of various configurations of the sling.
Figure 5:
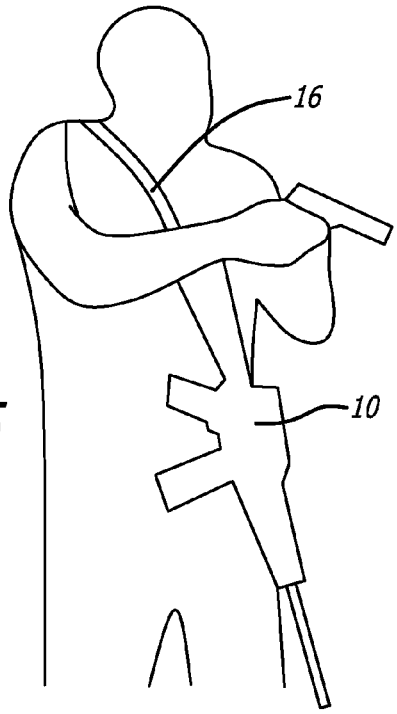
Figure 6:
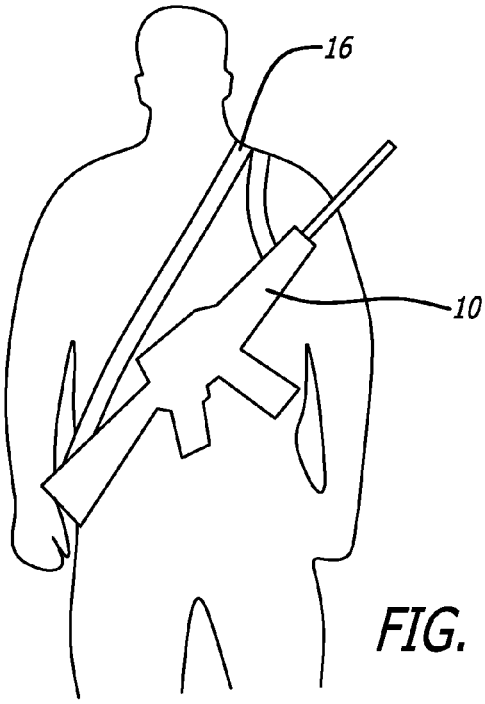
Figure 7:
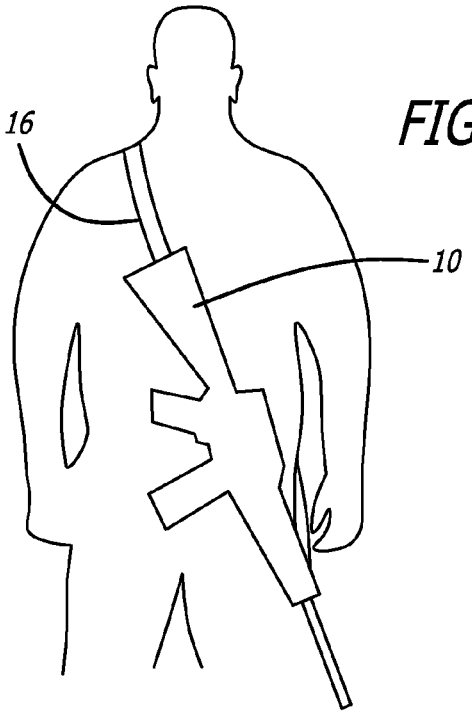
Figure 8:
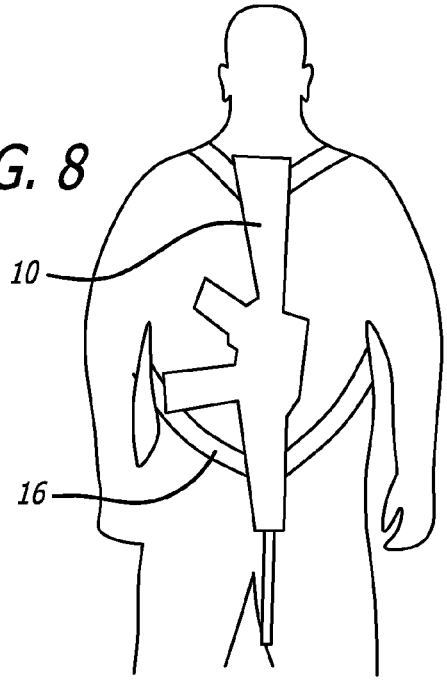
Figure 9:
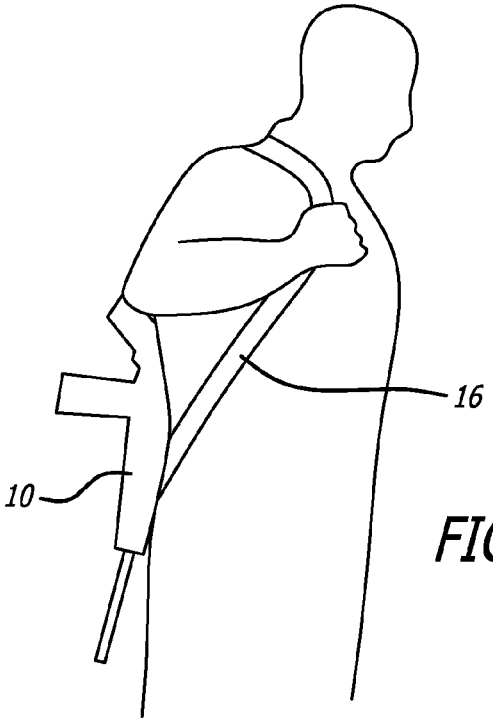

FIG. 3 illustrates the sling 16 removed from the weapon 10. A wide polypropylene belt 32 having a width of one and one half inches forms the over-the-shoulder portion of the sling 16. The belt 32 passes through a retainer reducer having a first slot 36 that receives the strap 18 and a second slot 38 that receives the belt 32. A first end of the belt 32 is sewn at the buckle 26 and a second end 42 of the belt 32 is attached to a slip lock buckle 44, where the belt first passes through buckle 44 to form a secondary loop 46. By adjusting the length of belt 32 passing through buckle 42, the size of the secondary loop 46 can be adjusted by the user. Note that the reduction or expansion of the secondary loop 46 affects the size of the sling 16, providing an easy adjustment mechanism for controlling the overall size of the sling 16.

The secondary loop 46 forms the attachment point for an intermediate belt linking portion 50. Belt linking portion 50 comprises a first linking buckle 52 that couples the secondary loop 46 to the intermediate belt linking portion 50. A short strap 54 includes a sewn loop 58 that holds a first piece 60 of a side squeeze, non-reversible locking buckle 62. The second end piece 64 of the side squeeze non-reversible locking buckle 62 is attached via attachment strap 68 to a three point adjustment buckle 70. Three point adjustment buckle 70 receives attachment strap 68 to connect with the non-reversible locking buckle 70, the belt 32, and which also receives an anchor portion 80 comprising strap 82, non-reversible releasable coupler 84, and anchor strap 86. Belt 32 at a first end 40 attaches to anchor strap 86. Anchor strap 86 may extend through the buckle 26 and form the rear keeper loop.

The sling 16 can be adjusted at slip lock buckle 44 to expand and contract the size of the sling. The position of the three point adjustment buckle 70 along the belt 32 also reduces the size of the sling and creates a secondary loop 90, which can be used to wrap around the butt of the weapon 10 to more securely connect the weapon to the sling 16.

Figure 10:
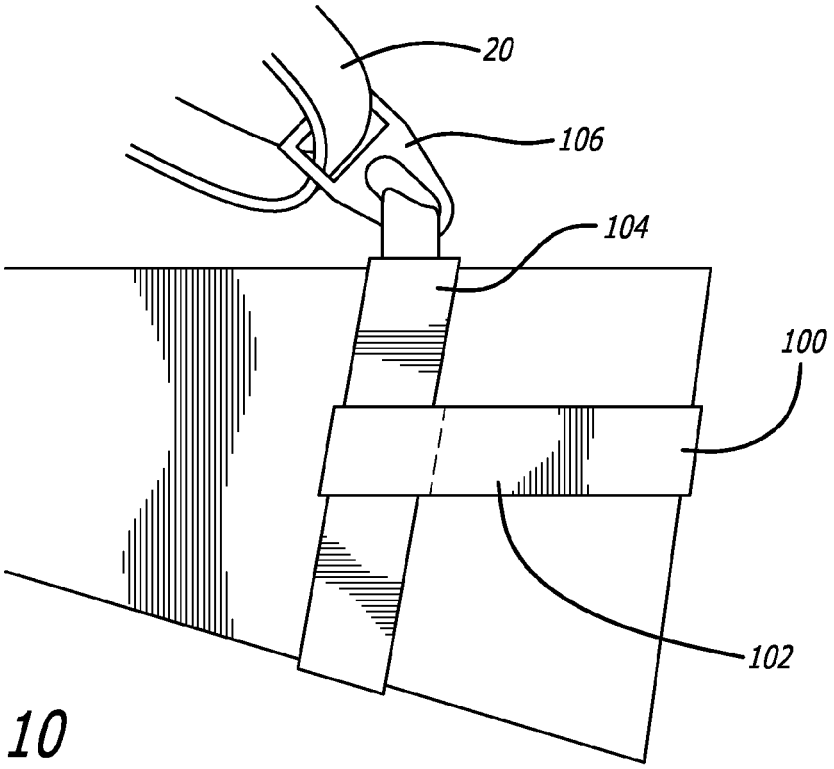
FIG. 10 is an enlarged, side view of an alternate connection embodiment.

FIGS. 4-9 illustrate various ways in which the sling 16 can be used to carry the weapon 10. In FIG. 10, an auxiliary rear stock strap 100 is used in place of the fixed contact point 14 of the preceding embodiment. Rear stock strap 100 includes a first length 102 that wraps around the back of the stock and a circumferential length 104 that encircles the stock, with a coupler 106 for receiving strap 20.

Figure 11:
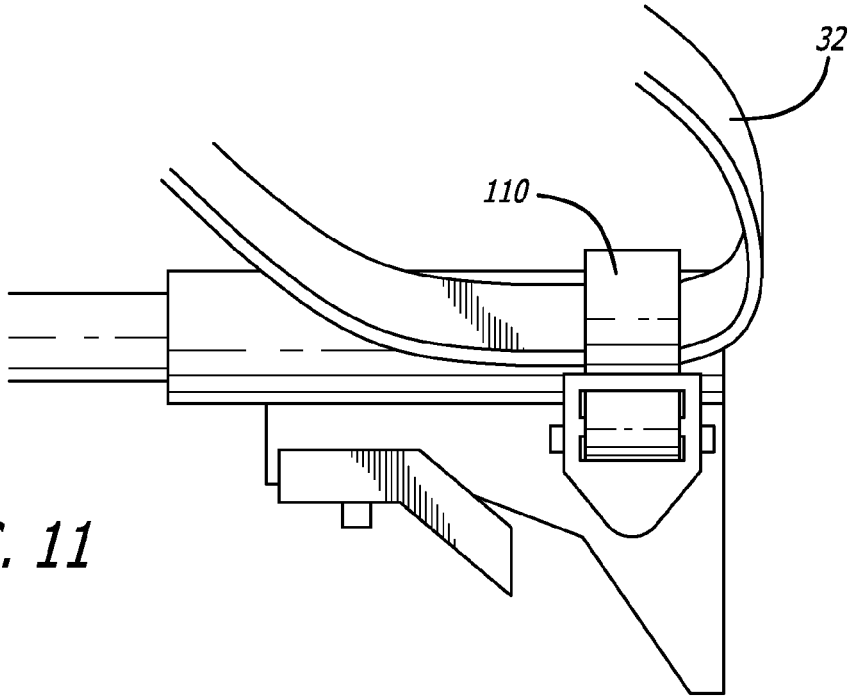
FIG. 11 is an enlarged, perspective view of another alternate connection embodiment.
Figure 12:
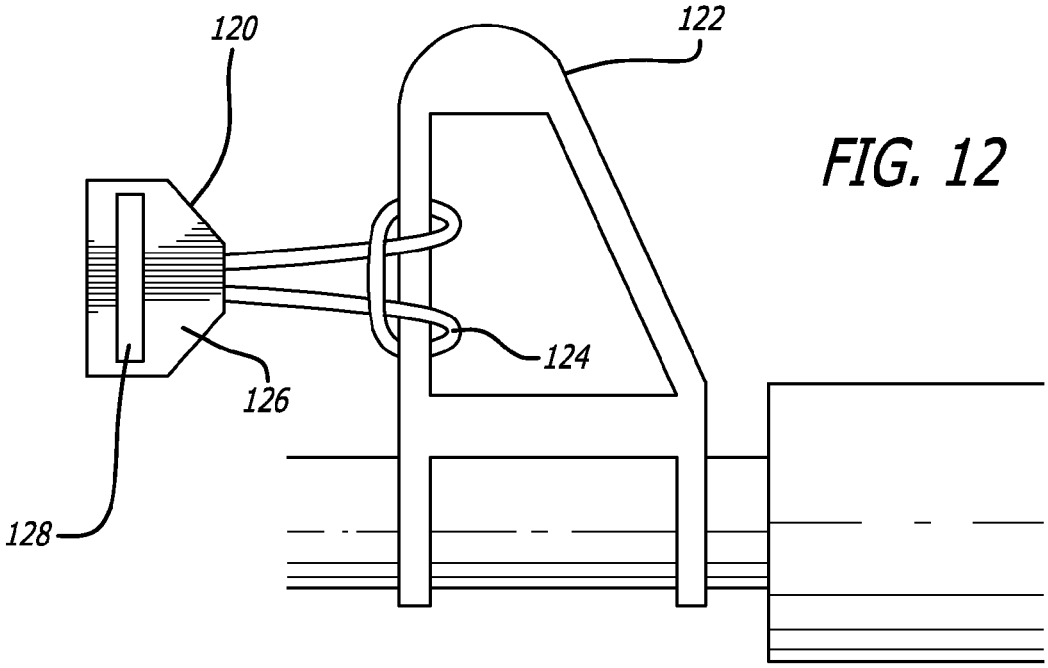
FIG. 12 is an enlarged, side view of yet another alternate connection embodiment.
Figure 13:
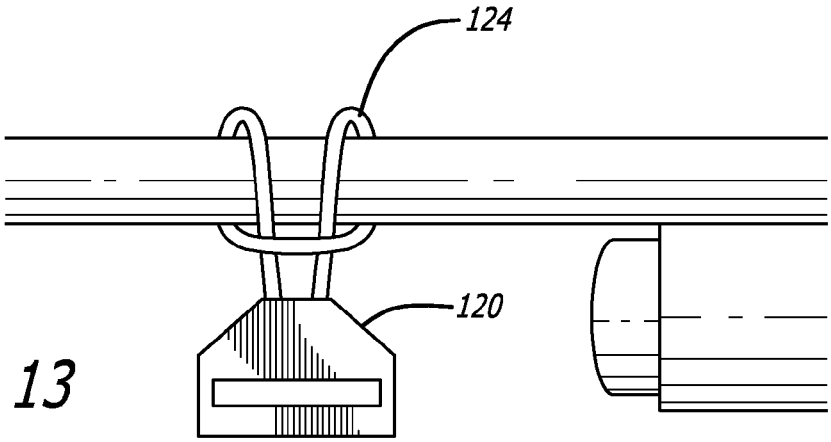
FIG. 13 is an enlarged, side view of still another alternate connection embodiment with a high temperature cord.

FIG. 11 illustrates another attachment embodiment for the front portion of the weapon, where the contact point 12 is replaced with a separate front keeper strap that wraps around the barrel of the weapon 10, and provides a loop to receive the belt 32 therein. FIG. 12 illustrates a nozzle attachment piece 120 that can connect to the weapon sight 122 via cable 124, which includes a coupler 126 having a slot 128 for receiving belt 32. FIG. 13 shows how the nozzle attachment piece 120 can also be used to wrap around the barrel itself in a quick and reliable manner.

Figure 14:
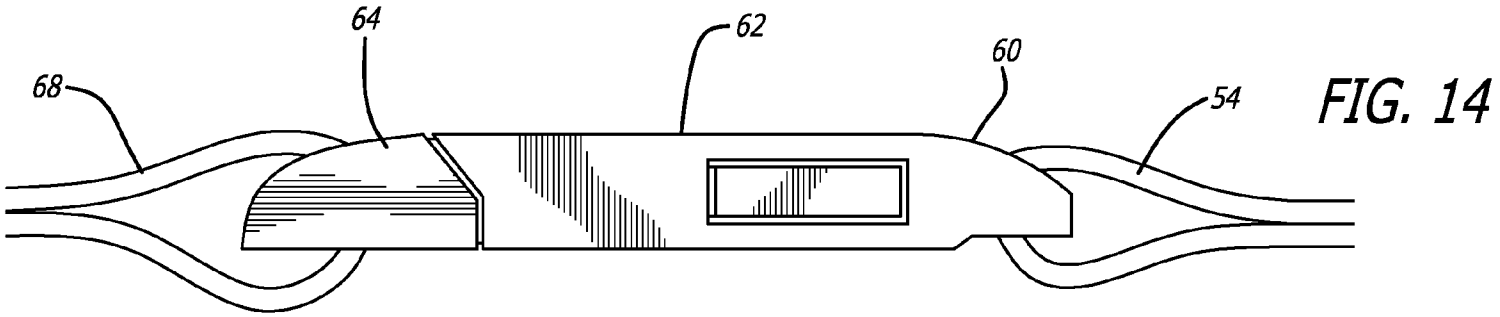
FIG. 14 is an enlarged side view of the non-reversible buckle in the correct orientation.
Figure 15:
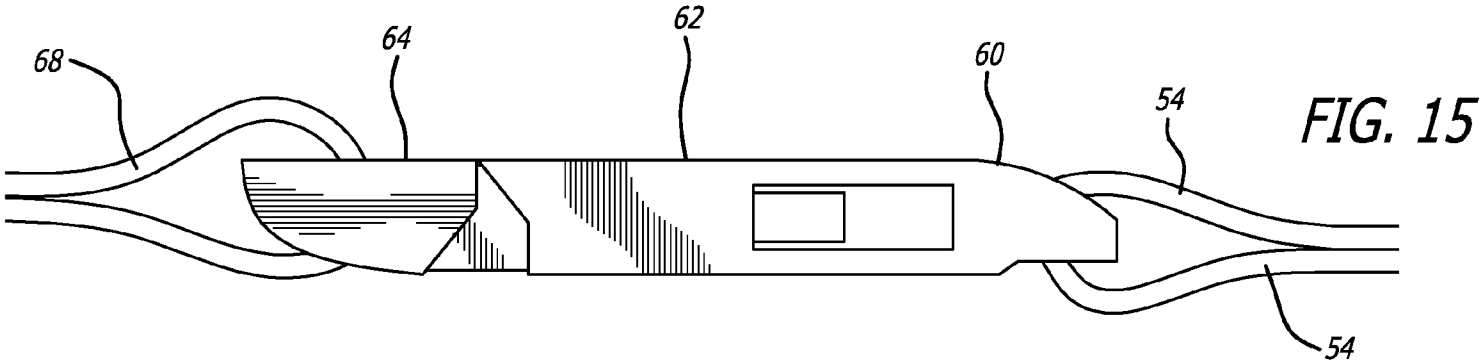
FIG. 15 is an enlarged side view of the non-reversible buckle in the incorrect orientation.

FIGS. 14 and 15 illustrate the non-reversible side squeeze locking buckle 62, illustrating a single orientation (FIG. 14) for locking the buckle. If the rotation of the second piece 64 relative to the first piece 60 is offset, the two pieces will not mate and it will be impossible to lock the sling into position. This feature ensures that the belt 32 will not be twisted when the sling is formed, particularly when visibility is diminished and the opportunity for misalignment is high.

The sling of the present invention is metal-free and resistant to high temperatures and made from impact resistant materials. The keeper loops are easily engaged with the weapon at the swiveling connection points 12, 14, requiring only that the straps be fed through the loops and secured with the associated buckle. This allows the sling 16 to be used with a multitude of different weapons of varying sizes and configurations, quickly and easily. The non-reversible buckles ensure correct orientation even in darkness without fumbling for the buckles, and the adjustable three point connection allows for plurality of combat-ready positions. Attachment pieces also adapt to non-standard stocks and barrels, allowing easy connection to more weapons than previous slings.

The foregoing description is intended to be illustrative only, and not limiting. Therefore, the scope of the present invention should not be construed as requiring any illustrated component or configuration, except as stated in the claims below.

I claim:

1. A multi-point sling that is attachable to a weapon, comprising: a first connecting strap coupling the sling to a first contact point of the weapon and a second connecting strap coupling the sling to a second contact point of the weapon, the first connecting strap including a first adjustable slip lock buckle and the second connecting strap including a second adjustable slip lock buckle, wherein each buckle receives an end of the respective connecting strap to form first and second keeper loops;

a retainer reducer having a first slot that receives the first connecting strap and a second slot that receives a belt, where a first end of the belt is attached at the second buckle and a second end is attached to a third buckle, where the belt passes through the third buckle to form a secondary loop;

an intermediate belt linking portion attached to the secondary loop, the intermediate belt linking portion comprising a first linking buckle that couples to the secondary loop, a strap attached to the first linking buckle and to a first piece of a non-reversible locking buckle having first and second pieces, the second piece attached via an attachment strap to a three point adjustment buckle; and the three point adjustment buckle linking the belt and intermediate belt linking portion, and further connected to an anchor portion comprising a strap, a non-reversible releasable coupler, and an anchor strap that is connected to the second buckle.

2. The multi-point sling of claim 1, wherein a width of the belt is wider than a width of the first and second connecting straps.

3. The multi-point sling of claim 1, wherein a width of the belt is one and one half inches.

4. The multi-point sling of claim 1, wherein each component of the sling is non-metal.

5. The multi-point sling of claim 1, wherein the first keeper loop attaches to a weapon barrel via a cable.

6. The multi-point sling of claim 1, wherein the second keeper loop attaches to a stock of the weapon via an auxiliary strap.

* * * * *